United States Patent [19]

Scheidler et al.

[11] 4,201,184

[45] May 6, 1980

[54] GLASS CERAMIC STOVE AND SUBASSEMBLIES THEREFOR

[75] Inventors: Herwig Scheidler, Mainz; Dietmar Wennemann, Alzey; Bernd Schwank, Koeln-Marienbrueck, all of Fed. Rep. of Germany

[73] Assignee: Jenaer Glaswerk Schott & Gen., Fed. Rep. of Germany

[21] Appl. No.: 795,940

[22] Filed: May 11, 1977

[30] Foreign Application Priority Data

May 15, 1976 [DE] Fed. Rep. of Germany ..... 2621801
Mar. 19, 1977 [DE] Fed. Rep. of Germany ..... 2712164

[51] Int. Cl.[2] ..... F24C 3/04
[52] U.S. Cl. ..... 126/39 J; 126/214 A
[58] Field of Search ..... 126/39 J, 39 H, 214 R, 126/214 A; 431/326

[56] References Cited

U.S. PATENT DOCUMENTS

| | | | |
|---|---|---|---|
| 3,241,542 | 3/1966 | Lutter | 126/39 J |
| 3,733,027 | 5/1973 | Napier | 126/39 J |
| 3,773,027 | 11/1973 | Dodd | 126/39 J |
| 3,832,988 | 9/1974 | Domer | 126/39 J |

FOREIGN PATENT DOCUMENTS

| | | | |
|---|---|---|---|
| 2633849 | 10/1977 | Fed. Rep. of Germany | 126/39 J |

*Primary Examiner*—Edward G. Favors
*Attorney, Agent, or Firm*—Hill, Van Santen, Steadman, Chiara & Simpson

[57] ABSTRACT

Gas-heated, glass-ceramic cooking stove incorporating at least one improved gas heated radiation burner subassembly. Each such burner subassembly comprises an infrared radiation burner, a glass, a housing about a burner chamber, a burner plate, a nozzle and mixer pipe, an exhaust gas ring, a waste gas conduit, an igniter, and safety and regulating means. A glass ceramic cover plate is integrally associated with each burner subassembly and serves directly as a cooking surface.

27 Claims, 5 Drawing Figures

20
START
OPEN GAS VALVE
21
RESET SPARK COUNTER
22
23
IS TEMP BELOW MIN?
NO
30
24
YES
25
EXCITE SPARK
INCREMENT SPARK COUNTER
26
29
DELAY
28
NO
27
IS COUNTER ABOVE MAX?
31
32
CLOSE GAS VALVE
33
DISPLAY FAULT CONDITION
35
IS TEMP ABOVE MAX?
39
40
IS TEMP ABOVE DESIRED VALUE?
NO
42
36
41
YES
43
IS TEMP BELOW DESIRED VALUE?
CLOSE GAS VALVE
37
44
DELAY
38
45

GLASS CERAMIC STOVE AND SUBASSEMBLIES THEREFOR

BACKGROUND OF THE INVENTION

Gas-heated cooking surfaces for gas stoves and heating members have been described in German Offenlegungsschrift 24 40 701.0-16 or in U.S. Letters Patent No. 3,494,350. In these printed publications, infrared radiation burners have been described in diverse embodiments which are principally suitable for heating glass-ceramic cooking surfaces. Particularly in the German Offenlegungsschrift No. 24 40 701.0-16, a gas stove with one or more cooking station burners is described wherein each burner is constructed in the form of a gas-heated radiation burner; that is, in the form of a burner subassembly in which the gas undergoes flameless combustion on the surface of perforated ceramic plate, and wherein, at a distance above each burner's ceramic plate, there is arranged a common glass-ceramic plate of a type which is known as such to the prior art. The space surrounding the burners is dimensioned to be of such a size that it takes up the combustion gases flowing laterally off from the periphery of the burners. Combusted gases can be freely emitted at openings which are located outside the glass ceramic plate and which are disposed at points removed from the working surface of the gas stove, but this space is otherwise closed on all sides. Each of the radiation burners is here provided with an ignition device and an ignition safety device to protect against a combustible gas mixture flowing off which has not been combusted.

Although gas-heated radiation burner subassemblies such as this are principally intended for stoves, or heating surfaces, the complicated nature of such heating systems results in considerable difficulties in the practical application of these prior art burners in connection with glass ceramic cooking surfaces. The specific problems consist in the circumstance that, while the glass ceramic cooking surface must be protected against overheating, and an adequate ignition safeguard must be maintained, the start-up cooking times must be short, the efficiency must be great, and the possibility of a good heat energy regulation must be provided. The combustion temperature of a burner's gas flame, or the temperature of the radiating ceramic plate associated with such an infrared-radiation burner, respectively, must amount to more than 900° C. for a good transmission of radiation. On the other hand, in order to ensure a good transmission of heat, the distance between the radiating ceramic plate and a cover plate must be as small as possible.

The permissible maximum temperature of such known common glass ceramic-cooking surfaces normally lies at about 700° to 750° C. When the pots used in cooking are good and have a flat bottom surface, this temperature is not exceeded even in the case of the above radiation temperature, since a good heat transmission takes place. However, when poor pots with non-flat bottom surfaces are used, or when there are extreme loads such as, for example, in the case of a pot whose contents have been cooked away, temperatures of more than 900° C. can occur on and in the glass ceramic-heating surface in only a few minutes. These possible but excessive temperatures must be reliably prevented by a temperature limiting device. The difficulty in this regard lies in the fact that, if the limiting device is inexpediently located or constructed, the start-up cooking times are unduly prolonged, and the limiting device functions in a non-constant manner, depending upon such variables as the type of pot used, the load applied to the cooking surface, and the like.

The practical situation involving the heating a cooking surface requires, in addition to such a temperature limiting device, the capability of a sensitive adjustment for achieving the most diverse energy stages or gradations through the operation of a suitable control device for the greatest possible variety of pots and foods cooked, whereby the limitation of a maximum usable temperature, as well as short start-up cooking times, are to be included as reasonable objectives. A sensitive regulating device with such characteristics that take into account the greatest possible variety of cooking utensils, presents great difficulties in fabricating in the case of the presently known gas-heated glass ceramic cooking surfaces.

A gas stove is described in the German Offenlegungsschrift 24 40 701.0-16, wherein one or more cooking location-radiation burners are located beneath a glass ceramic-cooking surface. The waste or combusted gas from these burners is taken into by a common, sufficiently large space between the burner(s) and the glass ceramic cooking surface plate, and is subsequently discharged at the rear of the stove. This embodiment is apparently suitable for heating the cooking surface. However, considerable difficulties in the precise energy control, as well as in the limitation of the maximum temperature of each individual cooking zone, result due to the fact that the plurality of burners used mutually influence one another as a consequence of the freely flowing exhaust gases. Moreover, this common exhaust gas space between the individual burners results in an additional partially heated space, as a consequence of which it is not possible to maintain precisely defined cooking zones.

The arrangement of the various elements employed for energy regulation, temperature limitation, ignition, and ignition safeguard must be established for each respective type of gas stove being manufactured, and since the size of the glass-ceramic-cooking surface and the arrangement of the individual burners needs to be varied from one gas stove type to another, there are consequently problems regarding construction and production, in addition to the considerable assembly costs involved in prior art stoves of this class.

BRIEF SUMMARY OF THE INVENTION

The present invention is intended to provide a gas-heated, glass-ceramic cooking surface in combination with at least one radiation burner subassembly which no longer manifests the deficiencies present in the aforedescribed prior art arrangements involving the mutual influencing of the regulating,-temperature limiting-, ignition-, and ignition safeguard-functions brought about by the need for a common exhaust gas space.

Moreover, the present invention aims at producing a substantially perfect functioning of the respective components employed for energy regulation, temperature limitation, ignition, and ignition safeguard for each burner subassembly by the separate arrangement of an individual exhaust gas space for each radiation burner and by the positioning of such respective components in a separate or individual exhaust gas space for each burner subassembly.

In addition, the present invention provides a gas-heated radiation burner subassembly suitable for use in combination with glass-ceramic cooking surfaces of substantially any size and/or shape. Such a subassembly is built as a compact constructional unit ready for installation wherein such sensory elements as those for energy regulation, temperature limitation, and ignition safeguard are securely arranged, since a trouble-free functioning of the cooking surface is particularly dependent upon a fixed and unchangeable position of these elements relative to one another.

Advancing from the arrangement according to German Offenlegungsschrift 24 40 701.0-16, such a subassembly is produced in accordance with the present invention by positioning, in the space for taking up the combustion gas surrounding the radiation burner, an exhaust gas ring which is provided with a discharge connection conduit. This exhaust gas ring is fixedly connected to the radiation burner subassembly, and, together with the radiation burner subassembly fits against the underside of an associated glass ceramic cooking surface. Thus, the distance between the perforated burner plate and the glass-ceramic cooking surface is determined. The radiation burner subassembly is provided with a sensor for the purpose of temperature limitation as well as optionally (but preferably) with a sensing element for the purpose of energy regulation. An ignition device, an ignition safety device, and a sensor for a temperature limiting device are installed and arranged in the space between the burner subassembly's perforated plate and the adjacent glass-ceramic cooking surface. All these individual elements or components are coordinated with and co-act in combination with one another in their geometric arrangement and in terms of their function.

The inventive radiation burner comprising a glass-ceramic cover, sometimes herein briefly referred to as the radiant or cooking surface, can be constructed in the form of several basic types, depending upon the mode of operation intended, and upon the desired precision of energy regulation. When several radiant surfaces are not each provided with a separate glass-ceramic plate, but are instead provided with a common glass-ceramic plate, a multi-burner functional cooking surface is obtained without additional outlay. Various embodiments of the radiant surface, or of the individual constructional units employed for this purpose, are described herein Other and further objects, purposes, advantages, aims, utilities, features and the like will be apparent to those skilled in the art from a reading of the present specification taken together with the drawings.

DETAILED DESCRIPTION

Figure 1:
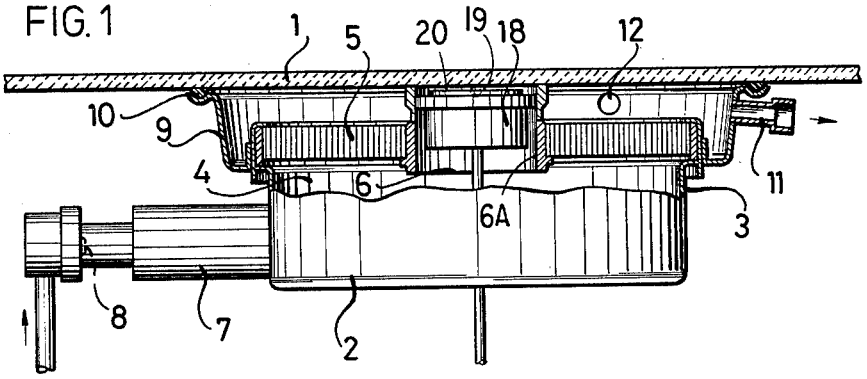
FIG. 1 shows a vertical sectional view of one embodiment of a fully automatic, gas heated, glass-ceramic stove assembly of this invention incorporating a single embodiment of a burner subassembly of this invention, some parts thereof broken away and some parts thereof shown in section.
Figure 2:
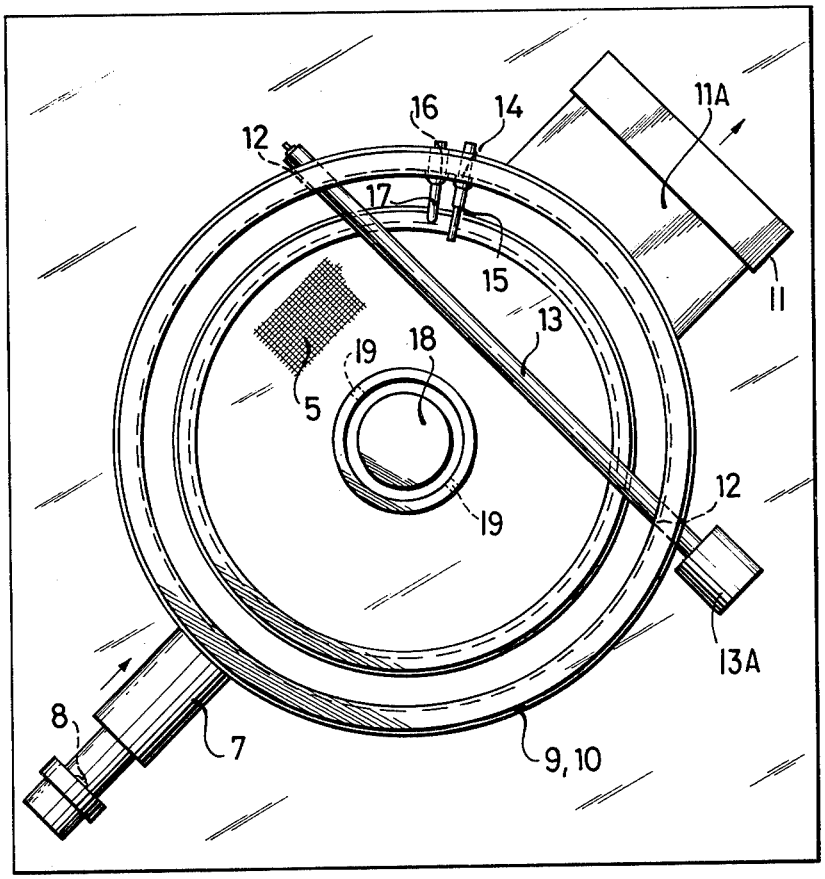
FIG. 2 shows a top plan view of the FIG. 1 assembly.

Referring to FIGS. 1 and 2, there is seen a glass-ceramic cover plate 1 which functions as a radiant cooking surface. Beneath cover plate 1 is located a gas heated radiation burner subassembly 2. Burner subassembly 2 includes a housing 3, which can be formed of metal, and a perforated burner plate 5 which is mounted across the open upper portion of the housing 3 as by a clamping arrangement or the like. A burner chamber 4 is defined by housing 3 and plate 5. The burner plate 5 has a generally circular perimeter and has a central axial opening 6 formed therein. A circumferential side wall portion of housing 3 interconnects with a mixer pipe 7 at one end thereof, the other end of mixer pipe 7 being interconnected with a nozzle 8. An exhaust gas ring 9 extends circumferentially of burner plate 5, ring 9 being formed of metal or the like. The ring 9 is here secured by an inturned lip to an upper edge portion of the housing 3 as by welding or the like.

The upper circumferential edge portion of the exhaust gas ring 9 is adapted to engage against the flattened underside of the glass ceramic cover plate 1 in a resilient or elastic fashion through intermediate bonding provided by a temperature resistant flexible elastic sealing ring 10 which bonds ring 10 to plate 1 and serves to support and suspend the burner subassembly 2. The spring action thus provided by ring 10 is necessary in order to insure a flexible yielding action between cover plate 1 and burner subassembly 2 in the event of a deflecting load exerted on the exposed face of cover plate 1. Except for apertures as hereinafter and hereinabove defined, the housing 3, the ring 9 and the cover plate 1 are in gastight interrelationship and interconnection with one another.

In exhaust ring 9 a circumferentially elongated aperture is formed to which is connected a connection conduit 11 whose free cross sectional area is so dimensioned as to render it adapted to conduct therethrough unimpededly exhaust gases discharged from the region generally between cover plate 1 and plate 5. Because of the height of the exhaust gas ring 9 a constant distance between the burner plate 5 and the cover plate 1 is maintained with adjacent surfaces of these respective bodies being in a generally spaced parallel relationship to one another which is preferably in the range of from about 10 to 15 millimeters. Preferably, the center of mixer pipe 7 and the center of connection conduit 11 are preferably aligned with one another when viewing an assembly of cover plate 1 and subassembly 2 along the axis of the burner subassembly 2.

Several openings are located in the exhaust gas ring. Thus, one pair of bore holes 12 is located in a generally aligned relationship one hole to the other of such pair, each hole being located in the range from about 5 to 10 millimeters bene..th the upper edge of the ring 9. These holes 12 serve the purpose of accomodating and supporting a temperature limiting device which, in the embodiment shown, comprises a rod expansion regulating element 13. Each one of the bore holes 12 is arranged so that the rod expansion regulating element 13 is transversely disposed across the segment of the burner plate 5 which is adjacent the mouth of the exhaust gas conduit 11. In this type of arrangement, the rod expansion regulating element 13 when provided with sufficient inherent sensitivity reliably corresponds to a suitable extreme range of thermal loads or stresses.

Another bore 14 is located in exhaust gas ring 9 so as to be positioned in the range of from about 10 to 20 millimeters from the mouth of the exhaust gas conduit 11 in cercumferentially spaced relationship thereto. Bore 14 is fitted with an ignition plug which is electrically operated by means of which gas can be ignited through a pulsed or time phased sparking externally controlled by an operator of the stove through wiring and switch means not shown. Typically, about 10 millimeters away from the bore 14 on a side thereof circumferentially opposite from that wherein the mouth of conduit 11 is located a bore 16 is provided. Into bore 16 is fitted a thermal element 17. The tip of thermal element 17 is positioned so as to be spaced typically at a distance from about 5 to 7 millimeters above the upper face of the burner plate 5. The thermal element 17 provides for a satisfactory ignition safeguard in the known fashion based upon the thermo-electric principle. For example, the thermal element 17, with appropriate logic circuitry (not detailed) is adapted to sense sparking at the ignition plug 15. If, within a short time after the sparking, the temperature in the vicinity of thermal element 17 does not rise to a suitable level a further sparking at plug 15 can be initiated, with the operation repeated until ignition is achieved, or if ignition cannot be achieved after a number of resparks, gas flow through the nozzle 8 can be constricted using a valve (not shown) and appropriate circuitry not shown. The element 17 may also be responsive to a low temperature condition to automatically energize the ignition plug 15. High temperature protection is achieved by the rod 13, which elongates when heated to operate a switch 13A. Then, by appropriate electrical and logic circuitry, gas flow through nozzle 8 is cut off by appropriate valving (not shown).

In a burner subassembly 2, the temperature limitation means, the ignition means, and the ignition safeguard means can also be provided another manner whereby these regulation means are in turn placed at defined locations in the cover plate 1 and then are coordinated with one another. Thus, for example, one can provide a rod expansion regulating element constructed generally in the manner of element 13 but having switches 13A operative at two switching points, such that a lower switching point provides a desired ignition safeguard while the upper switching point provides a desired maximum temperature limitation. One can, if desired, use for the purpose of ignition a special heating filiment having a temperature sensing resistance element of at least up to about 1250° C. which is then positioned about 10 to 15 millimeters away from the mouth of the exhaust gas conduit 11 circumferentially and about 5 millimeters from and above the edge of the burner plate 5, for example.

One can use as a temperature limiting device a rod or ring shaped molten expansion sensor, a sensor functioning according to the principal of negative temperature coefficient or positive coefficient, or a sensor functioning according to the thermal electric voltage principal just as in the case of the ignition safeguard above described. Alternatively, one can employ a photoelectric transducer temperature or a positive temperature coefficient.

The central opening 6 in the burner plate 5 serves a purpose of accommodating a thermostatic sensor employed for the purpose of achieving thermal energy control. The arrangement of this sensor is critical since even the smallest geometric changes read to impairment of start-up cooking and continuation cooking conditions in an operating burner subassembly 2. Even small geometric changes can make an automatic cooking operation impossible. When suitable thermostatic sensor for employment in a burner subassembly 2 of this invention is a liquid capillary tube thermostat 18 with a temperature carrying or loading capacity of about 300° C., capillary tube thermostat 18 is mounted in a fixed position in support mountings contained in a central tube 6A located in opening 6 peripherally thereof. Thus, the capillary tube thermostat 18 is spaced beneath the cover plate 1 at a distance of about 2 to 5 millimeters. On the upper end or face of capillary tube thermostat 18 and about its entire circumference there is provided a 2 to 4 millimeter thick coating of a thermally insulating material such as a material comprised of aluminum silicate fibers, for example. Such insulating material is resiliently pressed against the underface of the cover plate 1 so as to provide a desired spacing between the upper end of tube 18 and the cover plate 1. In the embodiment shown, approximately 2 millimeters beneath its upper edge the tube 18 is provided with four circumferentially equally spaced slots (alternate pairs of such slots thus being diametrically aligned with one another across tube 18). Each of these slots has a free cross sectional area of about 5 to 8 square millimeters. Into and through these slots flow a portion of the exhaust or combusted gas from the region of plate 5 which combusted gas, in combination with the temperature of the cover plate 1, heats up the sensor contained within tube 18. In this manner, the so-heated sensor, depending upon the preselected switching point switches the full gas current passing the nozzle 8 on and off cyclically during operation of an individual burner assembly 2 thus rendering possible a fully automatic cooking operation. The wiring circuitry and logic employed to implement the functional operation of the sensor in tube 18 as well as the valve are not detailed but conventional components may be employed known to the art of digital controls and the like. By selecting and operating temperature range between a low value (controlled by the ignition safeguard means) and a high temperature (controlled by the rod expansion regulating element) an operator of a stove having incorporated thereinto a burner subassembly 2 thus controls the temperature at which a particular species of food is to be cooked on the face of cover plate 1 overlying such burner subassembly 2.

When sensors of a different constructional type are having a different operational mode, such as for example, negative temperature coefficient sensors, or the like, or with a higher temperature carrying capacity are employed, they can be precisely fixed in position and the same or in a different type of embodiment but likewise at predetermined location in relation to a burner subassembly and an associated cover plate.

The sensors can also utilize one portion of the exhaust gas exiting through conduit 11, for example, for the purpose of temperature control of a product being cooked. If only the temperature of the pot undergoing cooking or the temperature of the plate beneath the pot is used for temperature control purposes, the system has a tendency to fluctuate or hunt, because of too long a thermal time constant, and so no precise temperature adjustments are then possible. Locating the sensor below the cover plate, within the exhaust space, overcomes this problem. A direct contact of the measuring sensor on the cover plate 1 is possible when an adequate feedback responsive to rate of change in temperature is provided for by a corresponding electrical circuit, for example.

The radiant surface of a cover plate 1 can be operated fully automatically by means of corresponding manual adjusting knobs for the purpose of energy control and/or by means of external time function elements.

In another embodiment within the scope of this invention, energy regulation can also be achieved by virtue of the fact that the energy supplied to the cooking product on a cover plate is controlled by a chronologically dependent (that is, time dependent) energy pulsation or phasing. Although, generally, as sensitive a regulation of the temperature of the cooking product as in the afore described temperature dependent energy regulating system is not thereby achieved, this embodiment does however, offer the advantage of not requiring any special sensory elements for the purpose of energy regulation since the chronological pulsation or phasing can take place in external switching elements.

An automatic embodiment is possible also in the case of such a chronologically dependent energy regulating system by means of corresponding additional constructional units on the switch element.

Through the various possible ways of regulating energy therein described, which, with corresponding sensors and switching elements can be similarly applied to electrically heated cooking surfaces or heating members, there is provided for the first time the possibility of utilizing switching units of similar construction for gas and electric cooking apparatus independently of the form of energy used, a fact which presents the manufacturer of such apparatus with not inconsiderable advantages in terms of construction and cost. In utilizing these similarly constructed switching units, the functional parts additionally required for gas cooking surfaces, such as solenoid or electrical valves, energy supplied for the ignition safety device, and the like, are housed either in a trough shaped depression of a stove, sometimes considered as the burner box of a stove, or in an additional auxiliary unit associated with a stove.

Exhaust gas ring 9 contains an exhaust gas connection conduit 11 for exhausting gas from the interior regions of the burner subassembly 2. Optionally, a second pipe 11A can be attached to conduit 11 in such a manner, for example, that there is a gap of approximately 2 to 5 millimeters between a slightly telescopically interconnecting conduits 11A and 11. Through this gap fresh air is drawn into the conduit 11 according to the injection or asperation principal. As a consequence, exhaust gas can be cooled to non-critical temperatures in only a few centimeters of travel axially the conduit 11, a fact which is significant in terms of achieving a free discharge at a rear positioning wall of a stove assembly. Through such an exhaust conduit 11, an exhaust pipe can be continued or extended in a defined manner so that among other things the heated exhaust gas from the subassembly burner can be employed for the heating of a heat-retaining or warming zone, if desired.

In order to keep the environment of the space around a burner subassembly 2 sufficiently cool, the exhaust gas ring 9 of a give burner subassembly 2 can be heated by means of a temperature resistant insulating material, as those skilled in the art will appreciate.

Figure 3:
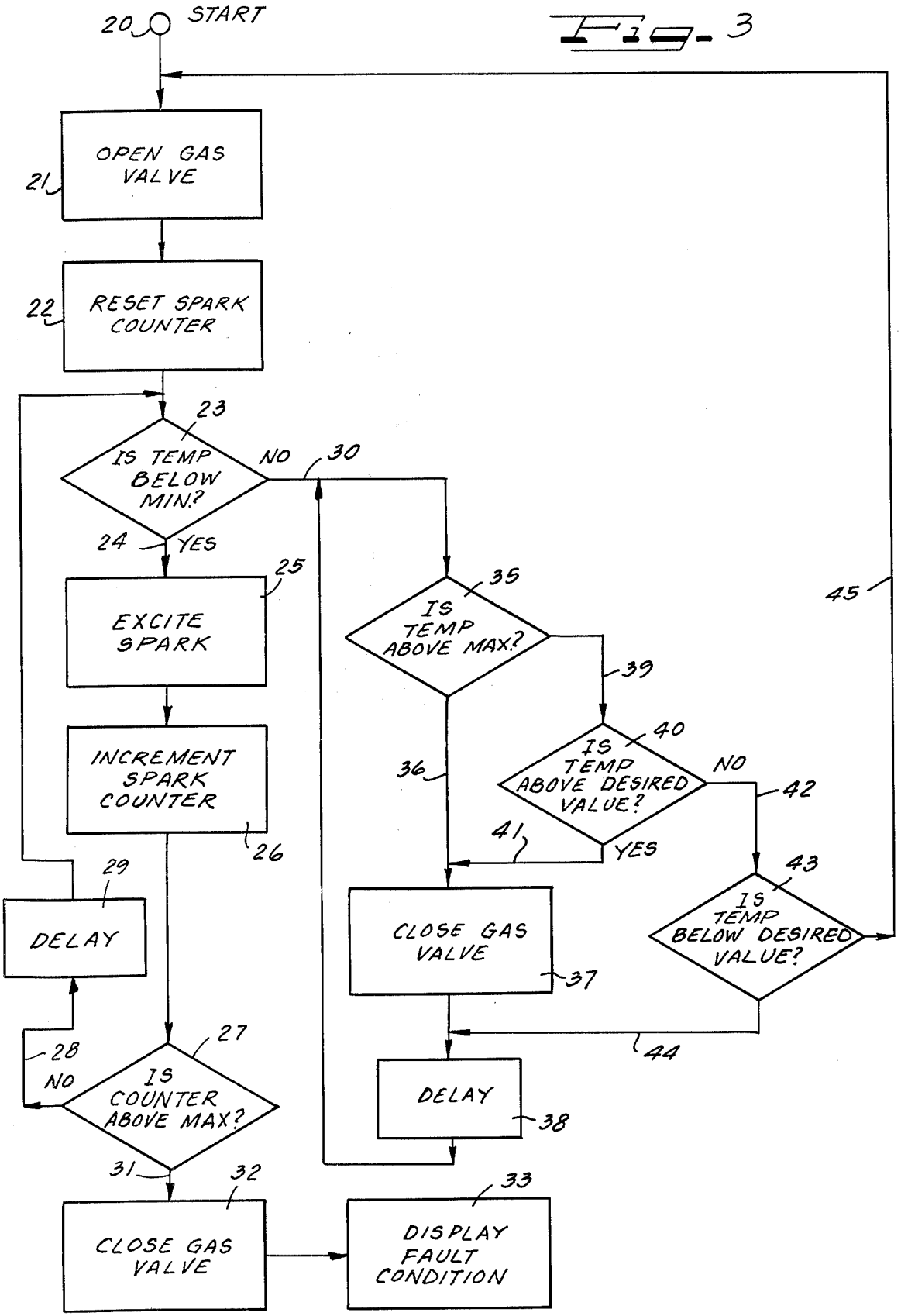
FIG. 3 shows a flow chart describing the sequence of operations in connection with the use of one embodiment of the present invention.
Figure 4:
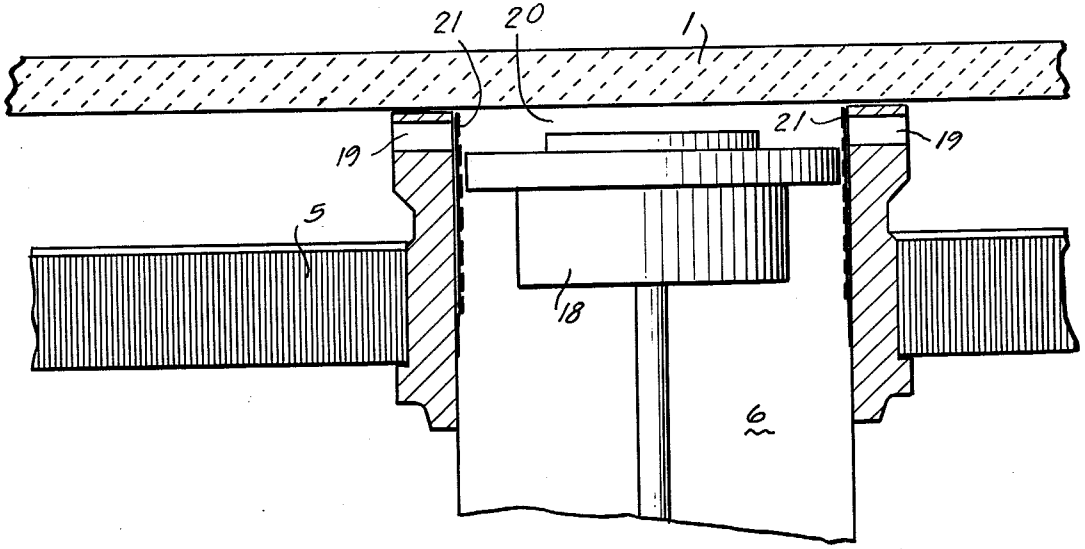
FIG. 4 is an enlarged fragmentary detail view of the embodiment shown in FIG. 1.
Figure 5:
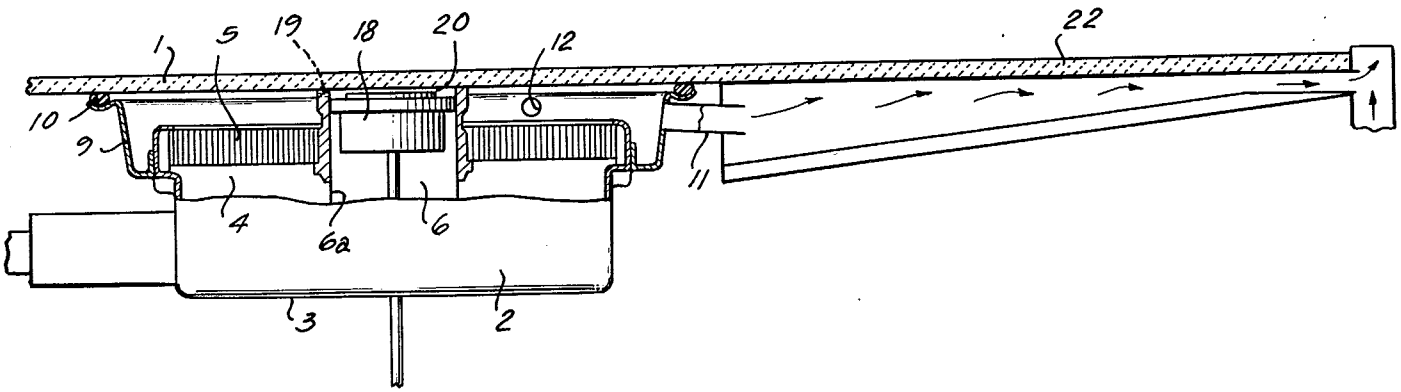
FIG. 5 is an alternative embodiment similar to FIG. 1 with corresponding parts thereof similarly numbered.

Referring now to FIG. 3 of the drawings, there is shown a flow chart illustrating a sequence of operations performed during the use of one embodiment of the present invention. The sequence is preferably carried out by standard data processing apparatus, through the use of suitable programs therefor. Alternatively, the sequence may be executed by apparatus especially designed to control operation of the burner units described above, using timing control apparatus such as a shift register or the like. The blocks shown in the diagram of FIG. 3 are referred to as units, it being understood that these blocks are representative of operational steps as well as apparatus employed for accomplishing such steps.

When a burner unit is to be energized, the sequence of FIG. 3 is initiated through a start terminal 20. The start terminal passes control to a unit 21, which opens the gas valve which supplied fuel to the burner. This allows fuel to flow to the burner unit, preparatory to its being ignited. When the gas valve has been opened, control passes to the unit 22, which resets a spark counter, the function and operation of which is described hereinafter. Then control passes to a unit 23, which is controlled by the thermal element 17, which is responsive to the temperature within the exhaust chamber of the burner. If the temperature is below the minimum value which is encountered during normal operation of the burner, control is passed over a line 24, whereas control is otherwise passed over a line 30. The first time the decision unit 23 is entered, the temperature is below the minimum, and so control passes over the line 24 to a unit 25, which excites the ignition plug or spark generator 15, to ignite the fuel which has been introduced into the burner. Control then passes to a unit 26 which increments the spark counter, which was reset by operation of the unit 22. Control then passes to the unit 27 which examines the content of the spark counter, to determine if more than a predetermined number of sparks have been excited in an effort to ignite the gas. The first time that the unit 27 is entered, the counter manifests a quantity less than this amount, and so control passes over a line 28 to a delay unit 29. The delay unit 29 returns control to the unit 23, after a suitable time delay, which corresponds to an interval slightly longer than the response time of the thermal element 17. If the first spark has not been successful in igniting the gas, the exit from the decision unit 23 will again be over the line 24, and the spark is re-excited, in a further attempt to ignite the gas. The spark counter is then incremented, and control is passed to the unit 27 to examine the content of the spark counter.

Control remains in the loop just described, as long as the gas fails to ignite, so that the exit from the decision unit 23 each time is over the line 24. If a number of retries to ignite the gas proves unsuccessful, so that the content of the counter exceeds the predetermined number and control exits from the unit 27 over the line 31 to the unit 32. The unit 32 closes the gas valve, and passes control to a unit 33 which displays a fault condition. In this manner, the gas supply is shut off if the burner cannot be ignited.

The control loop, including the decision units 23 and 27, is re-entered whenever the temperature is sensed as being below the desired value, so that if the combustion of the gas is for some reason terminated, the re-start procedure occurs automatically.

When the gas has been successfully lit, control passes over a line 30 to a unit 34 which resets the spark counter, and then passes control to the unit 35. The unit 35 examines the state of the switch 13*a*, operated by the sensor 13, and determines if the temperature within the chamber sensed by the sensor 13 is above the maximum permissible value. If it is, control passes over a line 36 to a unit 37 which closes the gas valve, after which control passes to a delay unit 38 and then returns to the decision unit 35. Closing the gas valve, by means of the unit 37, effects a gradual reduction in temperature, and when the temperature is reduced to below the maximum value, control passes from the unit 35 over a line 39 to a decision unit 40. The decision unit 40 determines whether the temperature is above the desired value, as sensed by the sensor 18. The desired value is preferably set in the conventional way by manually operable means (not shown) for establishing the desired temperature of the cooking unit. If the temperature remains above the desired value, control passes over a line 41 to the unit 37, which closes the gas valve, and after a delay, returns control to the decision unit 35.

The closing of the gas valve by the unit 37, whether receiving control from the unit 35 or the unit 40, operates to reduce the temperature of the burner unit, so that eventually control can pass from the unit 40 over a line 42 to a decision unit 43. The decision unit 43 determines whether the temperature as sensed by the sensor 18 is below the desired value, as set by the manual control (not shown). Typically, the desired value which controls operation of the unit 43 is somewhat lower than the value which controls operation of the unit 40, so that there is a band of temperatures which are neither too high nor too low, on either side of a nominal temperature corresponding to the setting of the manual control by an operator. As long as the temperature remains above the desired value, control exits from the unit 43 over a line 44, which returns control to the unit 35 after the delay imposed by the delay unit 38.

When the temperature as determined by the sensor 18 falls to below the desired value, control exits from the unit 43 over a line 45, and returns control to the unit 21, which opens the gas valve and passes control to the unit 22. Thereafter, the operation is the same as described above in connection with the starting of the unit.

It is apparent that by the use of the program described in FIG. 3, combustion of the gas is automatically restarted, if it should be extinguished during a cooling period. In addition, periodic checks are made to determine whether the temperature is above the maximum permissible, and if it is, the gas valve is closed until a safe temperature level is restored.

Although, the flow diagram of FIG. 3 describes operation of the burner unit of the present invention in connection with a control which turns on and off the main gas valve, it is apparent that a proportional control of the gas valve may be used instead, during which the main gas valve is repeatedly opened and closed in periodic fashion, with the proportion of the open time to the closed time increased or decreased, as need be, in response to the operation of the decision units 40 and 43, when the temperature is above or below desired values.

In another arrangement, the unit 23 is responsive to a second switch **13*a* responsive to the temperature falling below a minimum value, and the thermal unit 17 is used to detect whether a spark has in fact occurred, pursuant to operation of unit 25. If no spark occurs, control is returned from line 28 directly to unit 23, so that a re-spark can take place immediately, without the delay imposed by the unit 29**.

The placing of the desired value temperature sensor 18 in the same chamber containing the sensor 18, the spark device 15, and the thermal element 17, makes it possible for all of these devices to cooperate with each other, with those elements which are temperature-sensitive being all sensitive to the same temperature within the chamber.

As is apparent from the foregoing specification, the present invention is susceptible of being embodied with various alterations and modifications which may differ particularly from those that have been described in the preceding specification and description. For this reason, it is to be fully understood that all the foregoing is intended to be merely illustrative and is not to be construed or interpreted as being restrictive or otherwise limiting of the present invention, excepting as it is set forth in the hereto-appended claims.

We claim:

1. A cooking stove assembly having a glass-ceramic cooking plate in combination with at least one burner assembly, each such burner assembly having a housing and a perforated burner plate in combination therewith, said burner plate and said housing together defining a burner chamber, said burner plate being disposed generally across an upper portion of said housing, said burner plate being generally spatially located in spaced parallel relationship to the underside of said cooking plate, said housing and said burner plate being maintained in fixed relationship to said cooking plate by a peripherally extending generally upstanding ring member secured on its lower edge portions to said housing and/or to said burner plate, and secured on its upper edge portions to said underside by elastic sealing means, said burner plate, said cooking plate, said ring member, and said sealing means together defining a heating chamber, each such burner assembly further having located in said heating chamber (A) a temperature sensor for temperature limitation, serving to detect when said cooking plate is exposed to predetermined excessive temperatures, (B) an ignition means for igniting gas, (C) an ignition safety means for detecting if gas ignition does not occur after operation of said ignition means, and (D) an energy regulating sensor adapted to sense temperatures within preselected temperature ranges.

2. The stove of claim 1 wherein said sealing means bears resiliently against said cooking plate in each said burner subassembly.

3. The stove of claim 1 wherein in each said burner subassembly a central passage extends through said burner plate and said passage is adapted to support said energy regulating sensor for sensing thermal conditions in both said heating chamber and in said cooking plate.

4. The stove of claim 3 wherein said energy regulating sensor is mounted resiliently against said cooking plate.

5. The stove of claim 3 wherein said energy regulating sensor has a temperature carrying capacity of below 500° C., and is insulated from the direct radiation of the burner plate by means of insulation.

6. The stove of claim 5 wherein said insulation is provided with apertures adapted to thermally couple said burner plate to said energy regulating sensor.

7. The stove of claim 6 wherein said apertures are provided with small bi-metal plates which close said apertures in a cold state, but which increasingly expose the cross-sectional area of each said aperture upon heating.

8. The stove of claim 6 wherein the active part of said energy regulating sensor is fixed in a position about 3 to 10 mm beneath said cooking plate under a sheet metal hood cover.

9. The stove of claim 4 wherein said energy regulating sensor exhibits a temperature carrying capacity of about 750° C.

10. The stove of claim 5 wherein said energy regulating sensor is of the liquid expansion type.

11. The stove of claim 10 wherein said sensor is a molten salt.

12. The stove of claim 1 wherein said temperature sensor incorporates a negative temperature coefficient.

13. The stove of claim 1 wherein said temperature sensor is rod shaped.

14. The stove of claim 1 wherein each of said burner subassemblies is provided with at least two temperature sensors.

15. The stove of claim 1 wherein said temperature sensor is of the molten salt type.

16. The stove of claim 1 wherein said ignition means is of the electrical sparking type.

17. The stove of claim 1 wherein said ignition means incorporates a temperature stable heating filament.

18. The stove of claim 1 wherein said ignition safety means incorporates a thermal element.

19. The stove of claim 1 wherein said ignition safety means incorporates an expansion switch.

20. The stove of claim 1 wherein said ignition safety device functions photoelectrically.

21. The stove of claim 1 wherein said temperature sensor is adapted both for temperature limitation and also for ignition safety determination.

22. The stove of claim 1 wherein the exhaust gas conduits are placed in heat exchange relationship to a warming surface.

23. The stove of claim 1 wherein each of said burner subassemblies is constructed as an independent unit adapted for individual installation against a common cooking plate.

24. The stove of claim 23 wherein each of said burner subassemblies incorporates said temperature sensor, said ignition means, said ignition safety means, and said energy regulating sensor.

25. The stove of claim 1 wherein energy regulation is achieved by means of a chronologically dependent phasing in which the gas supply is released for variable lengths of time by means of chronological pulsation adjustable in an external switching assembly.

26. The stove of claim 25 wherein the release of the gas supply proceeds by way of a pulsed switching of a solenoid valve.

27. A cooking stove assembly having a cooking plate in combination with at least one burner assembly, each such burner assembly having a perforated burner plate, said burner plate being located in spaced relationship to the underside of said cooking plate, in fixed relationship to said cooking plate, means surrounding said burner plate and defining a heating chamber below said cooking plate, each such burner assembly further having located in said heating chamber (A) a temperature sensor for temperature limitation, serving to detect when said cooking plate is exposed to predetermined excessive temperatures, (b) an ignition means for igniting gas, (C) an ignition safety means for detecting if gas ignition does not occur after operation of said ignition means, and (D) an energy regulating sensor adapted to sense temperatures within preselected temperature ranges.

* * * * *